US009155379B2

(12) United States Patent
Castellana

(10) Patent No.: US 9,155,379 B2
(45) **Date of Patent: *Oct. 13, 2015**

(54) POWERED PAINTING SYSTEM

(71) Applicant: Tote Connection, Inc., Mission Viejo, CA (US)

(72) Inventor: Jerry D. Castellana, Anaheim, CA (US)

(73) Assignee: TOTE CONNECTION, INC., Mission Viejo, CA (US)

( * ) Notice: Subject to any disclaimer, the term of this patent is extended or adjusted under 35 U.S.C. 154(b) by 251 days.

This patent is subject to a terminal disclaimer.

(21) Appl. No.: 13/869,897

(22) Filed: Apr. 24, 2013

(65) Prior Publication Data

US 2013/0236232 A1 Sep. 12, 2013

Related U.S. Application Data

(63) Continuation of application No. 12/860,788, filed on Aug. 20, 2010, now Pat. No. 8,430,592, which is a continuation-in-part of application No. 12/328,758, filed on Dec. 4, 2008, now abandoned, which is a continuation-in-part of application No. 11/445,593, filed on Jun. 1, 2006, now abandoned.

(51) Int. Cl.

| | |
|---|---|
| ***A46B 11/06*** | (2006.01) |
| ***A46B 11/00*** | (2006.01) |
| ***B05C 17/03*** | (2006.01) |

(52) U.S. Cl.

CPC ..... *A46B 11/0006* (2013.01); *A46B 11/063* (2013.01); *B05C 17/0308* (2013.01); *B05C 17/0316* (2013.01); *A46B 2200/202* (2013.01)

(58) Field of Classification Search

CPC ..... A46B 11/0006; A46B 11/063; A46B 2200/202; B05C 17/0316; B05C 17/0308

USPC ..... 401/273, 284, 286, 287, 289, 187, 401/188 R, 189

See application file for complete search history.

(56) References Cited

U.S. PATENT DOCUMENTS

| | | | | | |
|---|---|---|---|---|---|
| 626,750 | A * | 6/1899 | Carter | 401/185 |
| 1,342,211 | A * | 6/1920 | Hainsey | 401/278 |
| 1,465,856 | A * | 8/1923 | Marsh | 401/287 |
| 1,829,850 | A * | 11/1931 | Thomas | 401/270 |
| 2,126,999 | A * | 8/1938 | Hollis | 401/287 |
| 2,127,000 | A * | 8/1938 | Emrich, Jr et al. | 401/279 |
| 2,591,845 | A * | 4/1952 | Magoon | 401/287 |
| 2,959,801 | A * | 11/1960 | Pelham | 401/281 |
| 7,407,336 | B2 * | 8/2008 | Giacomo | 401/287 |

* cited by examiner

*Primary Examiner* — Jennifer C Chiang
(74) *Attorney, Agent, or Firm* — Vista IP Law Group LLP

(57) ABSTRACT

A painting system comprises a pressurized paint canister and a pressure fed paint brush or powered paint roller connectable to the pressurized paint canister. The canister includes a paint reservoir, a self-sealing gas pressure fitting in fluid communication with the paint reservoir and configured to be connected to a gas pressure source, a paint outlet in fluid communication with the paint reservoir, and a removable cap for filling the paint reservoir with paint. The brush assembly includes a main body having a handle and a brush stock and a bristle bundle secured in the brush stock. A plurality of fluid distribution members extend into the bristle assembly and are multidirectionally flexible such that the distribution members flex substantially freely with the flex of the bristles in any direction. The fluid distribution members prevent paint flow when in an unflexed state and allow flow onto the bristles only when flexed.

20 Claims, 9 Drawing Sheets

POWERED PAINTING SYSTEM

RELATED APPLICATIONS

This is a continuation of U.S. patent application Ser. No. 12/860,788, filed Aug. 20, 2010, now U.S. Pat. No. 8,430,592, issued Apr. 30, 2013, which is a continuation-in-part of U.S. patent application Ser. No. 12/328,758, filed on Dec. 4, 2008, now abandoned, which is a continuation-in-part of U.S. patent application Ser. No. 11/445,593, filed on Jun. 1, 2006, now abandoned. The contents of the aforementioned patent applications are hereby incorporated herein by reference in their entirety. Priority to the aforementioned applications are hereby expressly claimed in accordance with 35 U.S.C. §120 and any other applicable statutes or laws.

FIELD OF THE INVENTION

The present invention relates generally to paint brushes and/or paint rollers, and more particularly to a self-contained paint brush and paint roller system utilizing a pressurized supply of paint, and apparatus to facilitate cleaning of the system.

BACKGROUND OF THE INVENTION

Paint brushes and paint rollers have been around for a very long time and are known to be relatively effective devices for applying a paint, varnish or other coating to a surface being coated. Throughout this specification, the term paint shall refer to any coating which may be applied to a surface with a paint brush, including without limitation, paint, varnish, stain, lacquer, polish, glaze, finish or other coating which can be applied with a paint brush.

Generally, a paint brush has a bundle of bristles having one end secured in a stock or head which has a handle. With a conventional paint brush, the bristles are dipped in a container of paint, such as a bucket, tray of cup. It order to most effectively apply the paint with the paint brush, it is important to get the right amount of paint on the brush, too much and the paint will drip off the brush; too little and the paint does not spread very far and may spread out too thin for providing proper coverage. Accordingly, after the brush is dipped, it is often necessary to swipe the brush over the edge of the container or on the surface of the container. The brush must be dipped in the paint numerous times to paint a large surface. The shortcomings of this very labor-intensive, time consuming process of painting with a conventional paint brush has led to the development of many alternative devices and methods for applying paint to a surface to be coated. For example, paint sprayers, paint rollers, and various types of painting pads have been developed. However, these alternative painting devices still do not have the control of a paint brush, nor do they provide the distinct and often desirable finish of paint brush.

Thus, in an attempt to alleviate the tiring, inefficient and labor intensive process of using a paint brush, several mechanisms for connecting a paint brush with a source of paint under pressure have been previously described. For example, such power-fed paint brushes, as they may be called, are typified by those shown in U.S. Pat. Nos. 1,829,850; 4,790,679; 4,676,685; 5,904,434; 5,071,278; and 5,139,357. These power-fed paint brushes all comprise a paint reservoir remote from the paint brush and a flexible tube connecting the reservoir to the paint brush. The paint reservoir has a pump for pumping paint contained in the reservoir through the tube to the paint brush. The tube is typically connected to the end of the handle of the paint brush and a lumen or tube within the handle conveys the paint to a paint distribution device which delivers the paint to the bristles of the paint brush.

However, these previously known power-fed paint brushes have a number of drawbacks. For one, the tube connecting the paint brush to the paint reservoir can be a nuisance because it gets in the way of the painting motion and makes it harder to perform the typical back and forth painting strokes. In addition, the paint distribution devices are ineffective for various reasons. For example, the paint spouts disclosed in U.S. Pat. No. 1,829,850, extend only to the upper end of the bristles. This creates problems with dripping and the flow of the paint to the lower end of the bristles and application to a surface being coated. And for those distribution devices which do extend to near the lower end of the bristles, the devices tend to inhibit the proper flexure of the bristles during painting. For instance, the distribution devices disclosed in U.S. Pat. Nos. 4,676,685 and 4,790,679 are wide, flat inserts with a plurality of opening near the lower (or distal) end. Although the inserts are disclosed as being flexible, it can be seen that such a device is very stiff in the transverse direction (i.e. the insets flex along with the bristles when bent by using the wide plane of the brush, but is very stiff when bent by using the narrow edge of the brush). It is common to use the edge of a paint brush to paint smaller and narrower surface areas.

Accordingly, there is need for powered painting systems having powered paint brushes and/or powered paint rollers which overcome the shortcomings and disadvantages of previous devices.

SUMMARY OF THE INVENTION

In one embodiment, the present invention comprises a pressurized fluid (typically paint) fed paint brush which has a paint distribution system which delivers paint to the proper portion of the bristles and does not unduly inhibit the proper flexure of the bristles when painting with strokes in a direction perpendicular to the wide dimension of the bristles (primary stroke) or in a direction parallel to the wide dimension of the bristles (edge stroke).

The power fed paint brush of the present invention comprises a main body having a handle having a proximal end and a distal end, and a bristle stock provided at the distal end of the handle. A bundle of bristles is secured in the bristle stock. In one innovative aspect of the present invention, a plurality of fluid distribution members extending from the stock into said bundle of bristles substantially parallel to the bristles. The fluid distribution members are very flexible (of similar flexibility or more flexible than the bundle of bristles) in all directions transverse to the longitudinal axis of the distribution members. The distribution members preferably comprise helical springs which are of similar flexibility, or more flexible than the bundle of bristles. The property of flexibility in all directions transverse to the longitudinal axis of the distribution members and having similar or more flexibility than the bundle of bristles is referred to herein as multidirectionally flexible, i.e. when the bristles are flexed in any direction, the distribution members substantially freely flex along with the bristles. Said in another way, the distribution members do not exhibit a substantial counteracting force against the direction of flexure. Moreover, when flexed or bent along with the bristles, the fluid flow path within the distribution members should not be closed or unduly restricted. In the unflexed state, the coils of the spring may be closed and when flexed (or bent) the coils open at the outer radius of the flexed spring. Thus, the unflexed/flexed state of the coils also controls the flow of paint. When unflexed, the coils slow the flow of paint;

and when the coils are flexed by bending the bristles and the springs, the springs open between adjacent coils allowing paint to flow outward. The proximal end of the distribution coils are in fluid communication with a source of pumped fluid, such as a manifold. The manifold is in fluid communication with a source of pressurized paint, such as a pump (e.g. a positive-displacement pump) in fluid communication with a fluid reservoir, or a pressurized fluid reservoir (e.g. a pressurized canister). For a pump powered system, a control switch may be provided on the paint brush to control the operation of the pump, such as turning the pump on/off and/or controlling the speed of the pump. For a pressurized fluid reservoir system, a flow control valve may be provided on the paint brush, in the fluid tubing, or on the fluid reservoir to control the flow of paint to the paint brush, including turning the flow on and off.

In operation, the pressurized paint source forces paint from the reservoir through a fluid flow path (such as a flexible tube) to the manifold of the paint brush. The fluid is then distributed through the manifold to the plurality of multidirectionally flexible distribution members. The fluid flows through the distribution members onto the bristles where it can be applied to a surface being coated using standard painting brush strokes.

In another aspect of the present invention, the present invention provides a pressurized fluid fed paint brush in which the entire device is contained in the hand-held paint brush such that there are no tubes between a remote reservoir and the paint brush. In this embodiment, a pump and its power source, and the fluid reservoir are fully self-contained on or in the main body of the paint brush. In this way, there is no external fluid transfer tube from the pump and reservoir to the paint brush to get in the way of the operator. Although any pump suitable for pumping fluids such as paint can be used, as an example, the pump may be a piston pump comprising a piston rod slidably received in a piston cylinder. One end of the piston cylinder is in fluid communication with a fluid reservoir which is disposed on or in the main body. The piston pump is powered by an electric motor having a drive shaft and a gear attached to the drive shaft. The motor gear may be operably coupled to a drive gear. A first end of a piston arm is rotatably connected to the drive gear and a second end of the piston arm is rotatably connected to a piston rod of the piston pump. As the motor is operated, the assembly causes a reciprocating motion of the piston rod which creates a pumping pressure. An outlet fluid flow path is also in fluid communication with the pump cylinder, separated by a one-way valve which is closed during the suction stroke of the piston pump to block back-flow from the outlet fluid flow path and is open during the compression stroke to allow fluid to flow into the outlet fluid flow path. The outlet fluid flow path delivers the fluid to a manifold and plurality of fluid distribution members, the same or similar to those described above.

The power-fed paint brushes may also be configured with a paint sprayer head and a valve which can be adjusted to select either paint brush mode or paint sprayer mode.

In another aspect, the present invention may comprise a gas (such as air) pressurized paint system having a paint brush and/or paint roller applicator. For example, rather than the positive displacement pump described above, the system may comprise a pressurized paint canister. The paint canister may be cylindrical in shape or any other suitable configuration. The paint canister is capable of withstanding at least 150 psi, and has a paint reservoir sized to hold 1.5 quarts of paint. The paint canister has an air pressure fitting/valve (such as a Schrader valve) in fluid communication with the paint reservoir. A source of pressurized gas is connected to the air pressure fitting to pressurize the canister. The source of pressurized gas may be removed after pressurizing the canister and the air pressure fitting automatically closes to maintain the pressure within the canister. In this way, the paint canister is then portable. The paint canister also has a paint outlet and a paint outlet shutoff valve. A flexible tube has a first end connected to the paint outlet and a second end which is connectable to the power fed paint brush or a power fed paint roller.

The same or similar power fed paint brush as described above may be used with the air pressurized painting system of the present invention, except that there is no need for the control switch. As described above, the power fed paint brush may further comprise a shutoff/throttle valve to control the flow of paint to the brush, and to shutoff the flow of paint to the brush (in addition to the control provided by the flexing of the springs).

The powered paint roller comprises a handle having a proximal end and a distal end, and a paint lumen therethrough. A paint inlet and a shutoff/throttle valve in fluid communication with the lumen are provided on the proximal end of the handle. The distal end of the handle has a cylindrical roller axle for receiving a paint roller. The roller axle has a first end connected to the handle and a threaded second end. The roller axle has a cavity in fluid communication with the paint lumen. The roller axle has a set of axle holes from the cavity through to the outer surface of the roller axle. The axle holes are arranged in a spiral arrangement about the axle. A pair of roller hubs is rotatably disposed on the roller axle, one at each end of the roller axle. The roller hubs are configured to be firmly received within a paint roller cover such that the paint roller cover rotates along with the hubs about the roller axle. The paint roller cover has roller cover holes extending from the interior of the roller cover to the outer knap, sponge, or other paint holding material, on the outer surface of the roller cover to allow paint to flow to the outer knap. A fluid seal is provided interiorly to each of the roller hubs to provide a seal between the roller axle and each of the hubs. A roller cover retainer attaches to the second end of the roller axle to hold the paint roller onto the roller axle.

In another aspect of the innovative powered paint system, a cleaning system is provided. For the powered paint roller, a cleaning jet is provided on the handle in fluid communication with the lumen in the handle. A cleaning jet shutoff valve is provided to shut off the cleaning jet when painting. The cleaning jet is aimed at the paint roller. In addition, a second cleaning shutoff valve is provided downstream of the cleaning jet and upstream of the roller axle.

In order to clean the powered paint roller or powered paint brush, a cleaning device is provided. The cleaning device may comprise a garden spigot connector connected to one end of a tube. The other end of the tube is connectable to the paint inlets of the paint roller and/or powered paint brush. The spigot connector is connected to a garden spigot, and the water is turned on to clean the paint roller or paint brush. For the powered paint roller, the shutoff valve to the cleaning jet is opened, so that water is sprayed onto the outer surface of the paint roller. The second cleaning shutoff valve may be left open to clean the interior of the roller axle or closed to direct the flow only to the cleaning jet. For the powered paint brush, the bristles and springs are flexed to allow water to flow through the springs and onto the bristles. Thus, the powered paint roller and/or powered paint brush can be quickly and easily cleaned after use.

In another embodiment of the present invention, a pressurized fluid fed paint brush is provided which is substantially the same as the power fed paint brush described above, except that the fluid distribution members are sealed on the distal ends (such as by a cap fitted to the distal end). The fluid distribution members are configured such that they are closed (preventing fluid from flowing out of the distribution members) when in the unflexed state, and open (allowing fluid to flow out of the distribution members) when flexed along with the bristles. The distal ends of the distribution members are sealed so that paint only flows out of the fluid distribution members when the fluid distribution members are flexed. Therefore, the fluid distribution members are self-regulated based on the flexing of the paint brush bristles and distribution members which flex along with the flexing of the bristles. As with the power fed paint brush described above, the fluid distribution members may comprise springs with a closed pitch in the unflexed state (i.e. adjacent coils are touching). The pressurized fluid fed paint brush may further comprise a shutoff/throttle valve to control the flow of paint to the brush, and to shut-off the flow of paint to the brush (in addition to the control provided by the flexing of the springs). This pressurized fluid paint brush may be used with the air pressurized painting system described above, or any other suitable source of pressurized paint.

The pressurized fluid paint brush may also be cleaned with the cleaning system described above. In a very advantageous aspect, the capped distribution members may provide an effective, dynamic cleaning action. By adjusting the water pressure connected to the cleaning system to be high enough to overcome the sealing effect of the fluid distribution members (for example, sufficient pressure to extend a spring from its closed pitch configuration), the distribution members move around in a random motion. This is similar to the end of a water hose when it is released with water flowing at a high pressure from the end of the hose. This dynamic cleaning action very effectively cleans the bristles of the paint brush.

BRIEF DESCRIPTION OF THE DRAWINGS

The invention is illustrated by way of example, and not limitation, in the figures of the accompanying drawings, in which like reference numbers refer to similar elements, and in which.

DETAILED DESCRIPTION OF THE INVENTION

Figures 1, 2, 3:
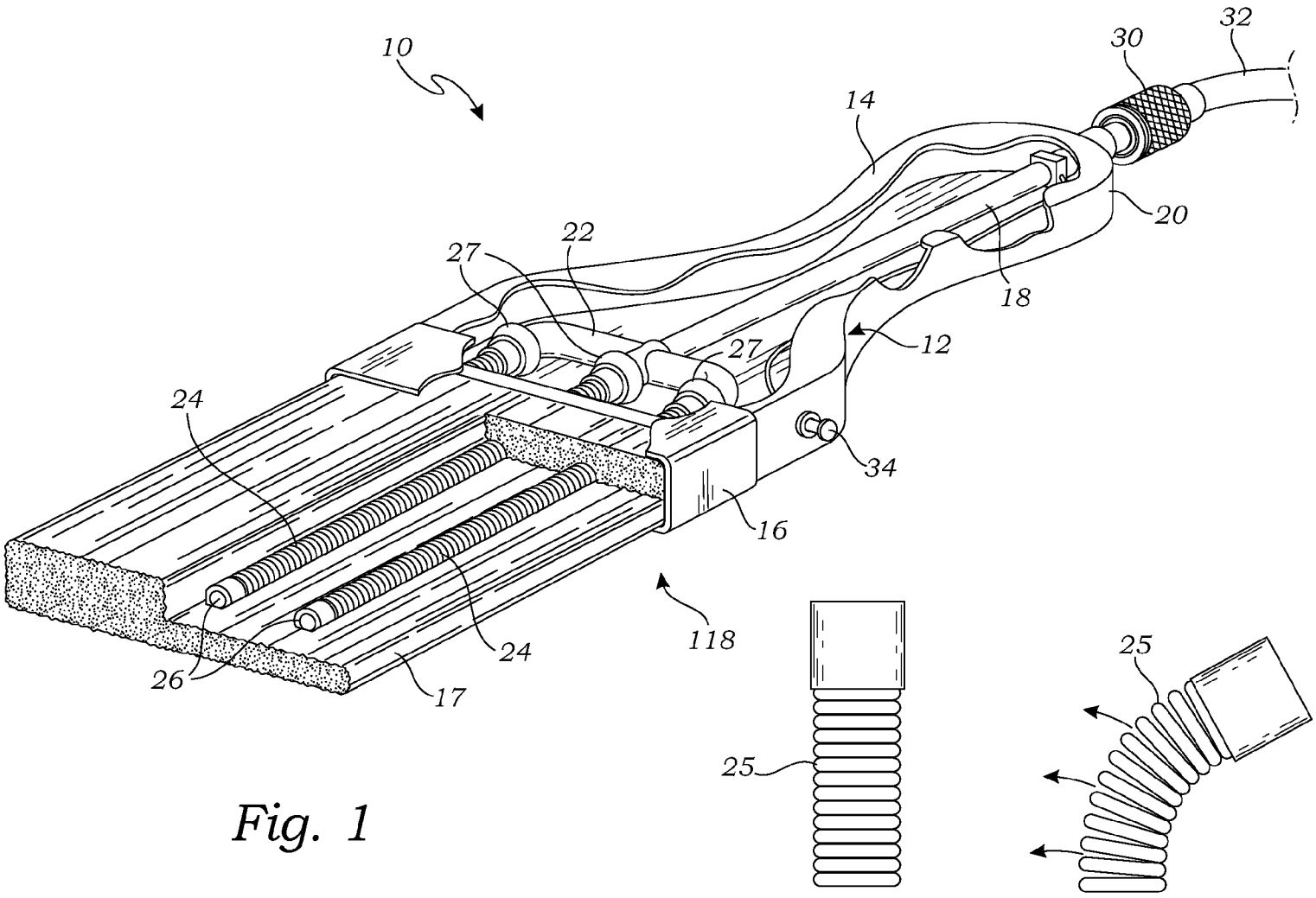
FIG. 1 is a perspective view (partially cut-away) of a power fed paint brush according to one embodiment of the present invention.
FIG. 2 is a side view of a helical spring distribution member in an unflexed state according to the present invention.
FIG. 3 is a side view of a helical spring distribution member in a flexed state according to the present invention.

Turning to FIG. 1, a power fed paint brush 10 according to the present invention is shown. The power fed paint brush 10 comprises a main body 12 having a handle 14 and a bristle stock 16. A bristle bundle 17 is retained by the bristle stock 16. The main body 12 may be formed of any suitable material such as wood, plastic or metal.

A fluid flow path 18 in the form of a bore or a tube within the bore runs from the proximal end 20 of the handle to a manifold 22 located in main body 12 near the bristle stock 16. The manifold 22 has a single inlet from the flow path 18 and multiple outlets in fluid connection with a plurality of fluid distribution members 24. The manifold 22 may be as simple as a junction of fluid flow paths such as the intersection of several tubes, or it may be a block having one inlet and a plurality of outlets.

The fluid distribution members extend into the bristle bundle 17 and extend to a point near the distal end of the bristles. The fluid distribution members 24 are very flexible (of similar flexibility or more flexible than the bundle of bristles) in all directions transverse to the longitudinal axis of the distribution members such that they do not inhibit the flexure of the bristles 17 when the paint brush 10 is being used. The property of flexibility in all directions transverse to the longitudinal axis of the distribution members and having similar or more flexibility than the bundle of bristles is referred to herein as multidirectionally flexible. The proximal ends 27 of the distribution members 24 are in fluid communication with the manifold 22 and the distal ends 26 of the distribution members 24 are open to allow fluid to flow out from the distribution members 24 and onto the bristles 17. The distribution members 24 may have additional apertures along their length for allowing fluid to flow out and onto the bristles. The distribution members 24 may comprise any suitable structure having the proper flexure and which can effectively deliver the fluid from the manifold 22 to the bristles 17, such as a very flexible plastic tube, fabric tube, or helical spring as described below.

In the example of FIG. 1, a single inlet flow path 18 supplies a manifold which distributes the paint to a plurality of distribution members 24, in this case, three distribution members 24, but fewer or more distribution members 24 may be used. For example, in the case of a 1 inch brush, one or two distribution members may be sufficient. In the case of a 2 inch brush, two distribution members may suffice. And in the case of a 3" brush, three distribution members may be used.

The distribution members 24 preferably comprise helical springs 25 (see FIGS. 2 and 3) which are of similar flexibility, or more flexible than the bristle bundle 17. In the unflexed state, the coils of the spring 25 may be closed as shown in FIG. 2 and when flexed (or bent) the coils 25 open at the outer radius of the flexed spring 25 as shown in FIG. 3. This provides the advantageous result that the paint will flow out of the side of the spring 25 which is toward the surface being coated by the paint brush because the surface is on the outer radius of the flexed bristles 17 and distribution members 24.

The proximal end 20 of the handle 28 has a connector 30 which may be connected to a flexible supply tube 32. The tube 32 and other tubing used by the system described herein preferably have a diameter of ¼ inch, or less. The small diameter tubing reduces the amount of waste used to fill the lines of the painting system, while still providing sufficient flow volume to the paint brush or paint roller. The tube 32 may be connected to a suitable source of fluid under pressure such as fluid pump unit 80 shown in FIG. 4. A control switch 34 may be provided on the paint brush 10 for controlling the operation of the pump unit 80, such as turning the pump 82 on/off and/or controlling the speed of the pump 82. The control switch 34 is operably coupled to the pump unit with which the paint brush 10 is utilized. The control switch 34 may be a pneumatic switch, electrical switch, or a wireless control switch which sends a wireless signal to the pump unit. Alternatively, a valve (not shown) may be provided in the fluid flow path 18 which can be open, closed and/or adjusted to control the flow of fluid to the paint brush 10.

Figures 7, 8:
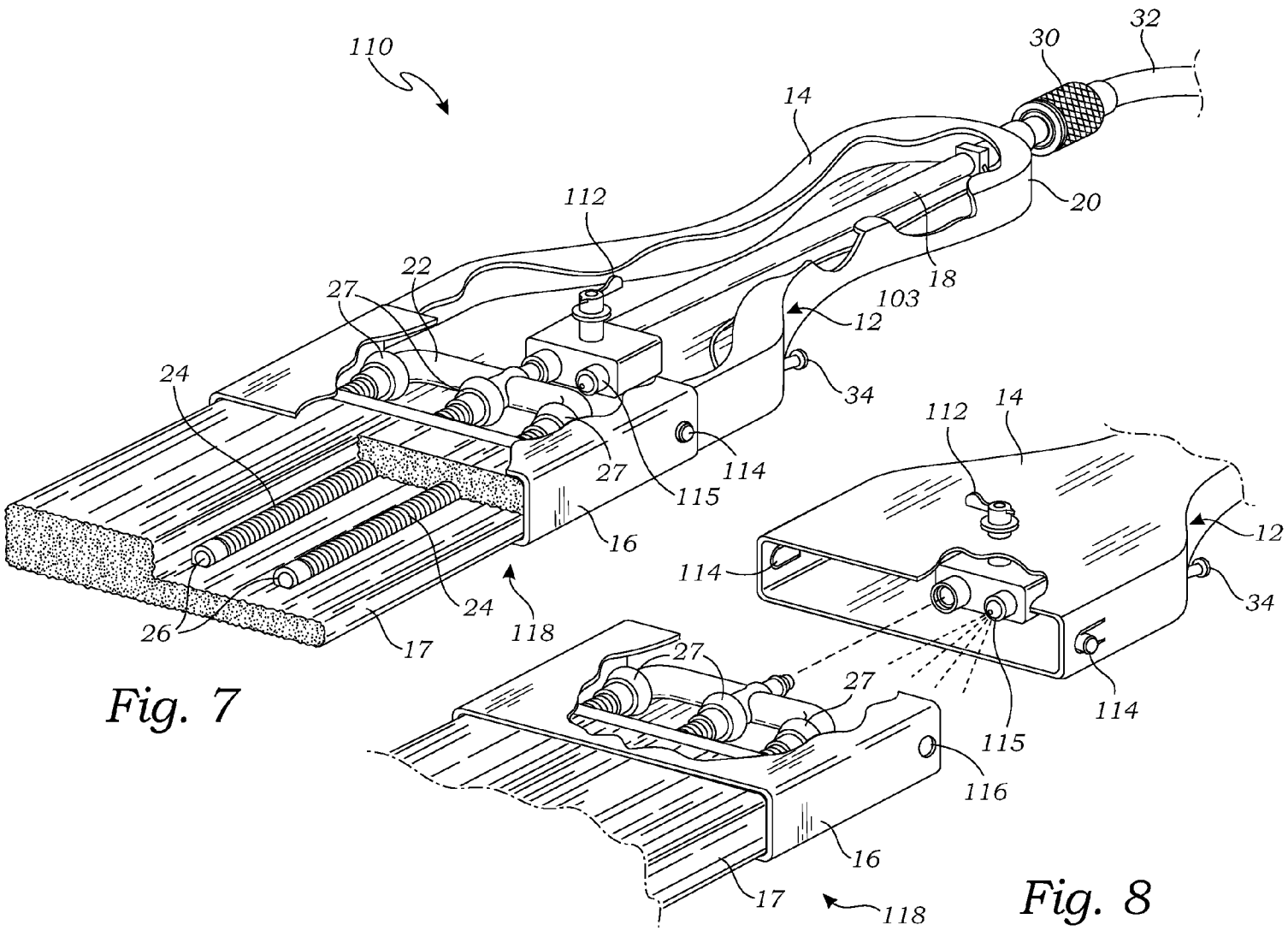
FIG. 7 is a perspective view (partially cut-away) of a power fed paint brush having an airless spray nozzle according to one embodiment of the present invention.
FIG. 8 is a perspective view (partially cut-away) of the power fed paint brush of FIG. 7 with the brush head disconnected from the handle.
Figure 9:
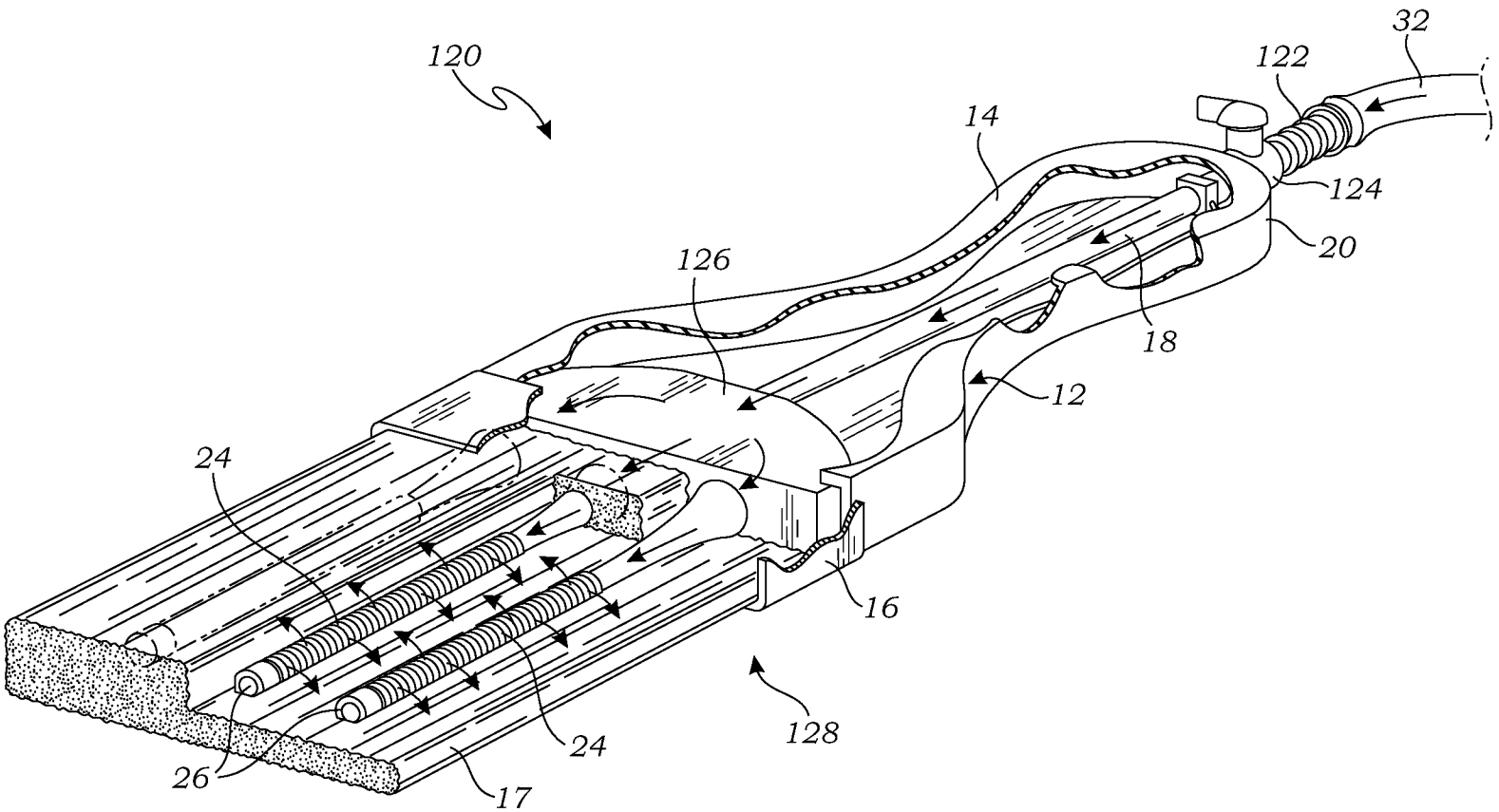
FIG. 9 is a perspective view (partially cut-away) of another embodiment of a power fed paint brush according to the present invention.

The paint brush head 118, comprising the bristle stock 16, bristle bundle 17, manifold 22 and distribution members 24, may be removable from the handle 14. This allows the operator to change the brush head 118 and also facilitates cleaning of the components of the paint brush 10. In this case, the distal end of the fluid flow path 18 is detachably connected to the manifold 22. Any suitable connection may be used, including a simple male-to-female fluid tight connection having a seal such as an o-ring or gasket, or a compression fitting. An example of a suitable connection is shown in FIGS. 7 and 8 between the manifold 22 and the ball valve 112. In addition, releasable fastening device may be used to releasably retain the brush head 118 to the handle 14. As an example, the clips 114 and detents 116, as shown in FIGS. 7 and 8, can be utilized.

Figure 5:
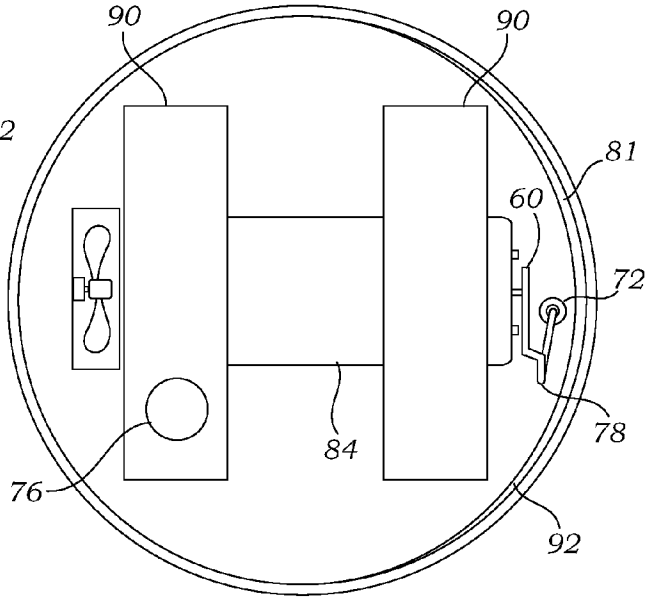
FIG. 5 is side view (partially cut-away) of a fluid pump unit according to one embodiment of the present invention.
Figure 4:
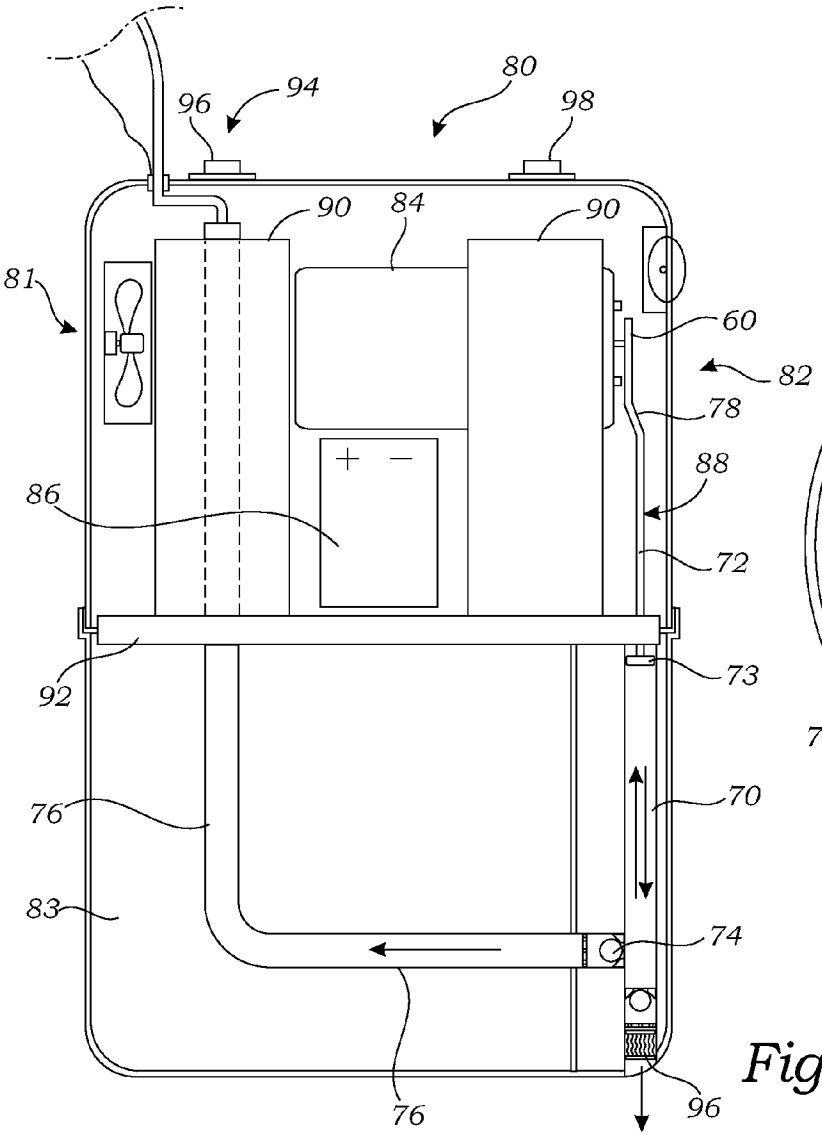
FIG. 4 is side view (partially cut-away) of a fluid pump unit according to one embodiment of the present invention.

Turning now to FIGS. 4 and 5, a fluid pump unit 80 according to the present invention is illustrated. The fluid pump unit 80 comprises a housing 81 which encloses a pump assembly 82 and a fluid reservoir 83. The pump assembly 82 includes an electric motor 84, a battery power source 86, and a pump 88. The electric motor 84 is secured to a pair of motor mounts 90 which are in turn secured to a motor plate 92. The electric motor 84 is electrically connected to the battery 86 through control electronics 94. The control electronics 94 may comprise a control board (not shown) operatively connected to a master on/off switch 96 and a momentary switch 98. The master on/off switch controls the master power to the pump unit 80, while the momentary switch 98 turns the electric motor 84 on/off when the switch is actuated. The momentary switch 98 is preferably a normally "off" switch which turns the motor off when the switch is not positively depressed, and turns the motor "on" when the switch is depressed. This momentary switch 88 may be conveniently provided directly on the paint brush 10 as discussed above.

The fluid reservoir 83 may hold about one quart, or one pint or two quarts depending on the desired capacity of the pump unit 10. The fluid reservoir 83 may have a fill port (not shown) or the top part of the housing 81 may be removable to provide access to the fluid reservoir 83 in order to fill it with fluid. The battery 86 may be a 9-volt cell, such as a lithium rechargeable battery cell or a standard alkaline 9-volt battery, or other suitable battery(ies).

The pump 88 may be any suitable positive displacement pump such as a piston pump, gear pump or peristaltic pump, for instance. The pump 88 shown in FIGS. 4 and 5 is a typical piston pump. The piston pump 88 comprises a piston cylinder 70 having a lower end placed inside the fluid reservoir 83 at or near the bottom. The piston cylinder 70 is secured to the pump unit 10 at a pivot point so that it can swivel along in order to maintain proper orientation to the reciprocating piston motion. A filter 96 may be provided between the fluid in the reservoir and the inlet to the piston cylinder for filtering the fluid before it is pumped to the paint brush 10.

A piston 72 is slidably received within the piston cylinder 70. The piston 72 may comprise a piston rod and a piston head at or near the lower end of the piston 72 or it may be a single, integral rod-like structure. A seal 73 is provided to seal between the piston 72 and the piston cylinder 70, such as an o-ring, a piston ring or other suitable seal.

The piston 72 is operably coupled to the electric motor by a piston arm 78 and a gear set. A first end of the piston arm 78 is rotatably connected to a drive gear 60 and a second end of the piston arm 78 is rotatably connected to the piston rod 72. The drive gear 60 mates with one or more gears which are coupled to a drive shaft of the electric motor 84. For example, depending on the speed and torque of the electric motor 84, one or more reduction gears may be utilized in order to adjust the speed of the motor 84 to the desired reciprocating speed of the piston pump 88. When the electric motor 84 is operated, the drive gear 60 rotates thereby causing a reciprocating motion (up and down) of the piston 72 which creates a pumping pressure.

An outlet fluid flow path 76 is also in fluid communication with the pump cylinder 70, separated by a one-way valve 74 which is closed during the suction stroke of the piston pump to block back-flow from the outlet fluid flow path 76 and is open during the compression stroke to allow fluid to flow into the outlet fluid flow path 76. A second one-way valve (not shown) may be provided between the inlet of the piston cylinder 70 and the reservoir 83 to prevent backflow into the reservoir during the compression stroke. However, it has been found that the back pressure provided by the reservoir 83 adequately prevents substantial backflow of fluid into the reservoir during the compression stroke of the pump 88. The outlet fluid flow path 76 is in fluid communication with a flexible supply tube 32 which may be connected to a power fed paint brush 10 as described above.

The fluid pump unit 80 can be provided with a belt clip or strap (not shown) attached to the housing 81 so that the unit 80 can be clipped to the operator's belt or strapped over the shoulder. In this fashion, the pump unit 10 is portable and hands free. The total height of the pump unit 80 is preferably less than 10 inches, more preferably less than 8 inches and more preferable less than 6 inches. The width of the pump unit is preferably less than 6 inches, more preferably less than 5 inches and more preferably less than 4 inches. The approximate weight of the pump unit 81, when empty of fluid, is preferably less than 3 pounds, more preferably less than 2 pounds and more preferably less than 1½ pounds. The pressure capacity of the pump 88 is preferably about 2 to 20 psi or more.

Figure 6:
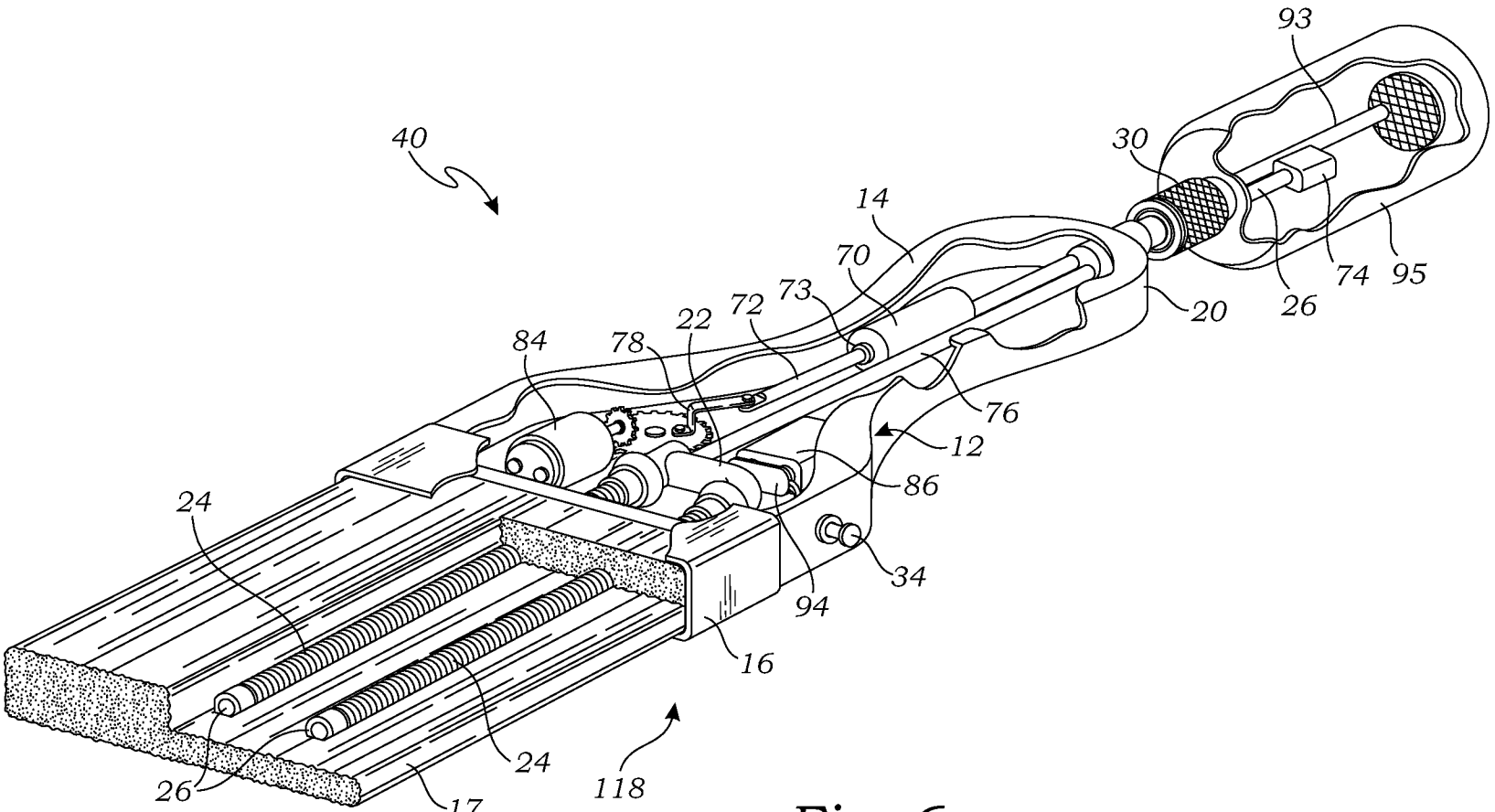
FIG. 6 is a perspective view (partially cut-away) of a fully self-contained power fed paint brush according to one embodiment of the present invention.

Now referring to FIG. 6, a fully self-contained, power fed paint brush 40 is shown, in which all components are provided on and/or in the paint brush. The term "on" in reference to an element being provided, mounted, secured or disposed "on" a second element shall mean that the first element is provided on, in, within or partially on, in, or within the second element. The term "in" used in reference to an element being provided, mounted, secured, or disposed "in" a second element shall mean that the first element is substantially completely within the second element. The paint brush 40 includes many of the same elements of the paint brush 10 and the pump unit 80 described above, such that like reference numerals refer to like elements, and the description for like elements shall be applicable for all described embodiments wherever relevant. For that matter, like reference numerals throughout the drawings and specification shall refer to like elements, and the description for like elements shall be applicable for all described embodiments wherever relevant.

The paint brush 40 comprises a main body 12 having a handle 14 and a bristle stock 16 which retains a bristle bundle 17. A pump 88 is disposed on or in the main body 12. The pump 88 may be any suitable pump such as a gear pump, piston pump or peristaltic pump, but is shown as a piston pump very similar to the piston pump 88 described above. The piston pump 88 comprises a piston 72 slidably received in a piston cylinder 70. A distal end of the piston cylinder is in fluid communication with a fluid reservoir 95. The distal end of the piston cylinder 88 may be placed directly into the fluid reservoir 95, or it may be connected thereto by a pick-up tube 93. The fluid reservoir 95 is secured to the handle 14 of the paint brush 40. Alternatively, the fluid reservoir can be attached to the main body 12 elsewhere from the handle 14 or it can be integral to the handle 14 such that the handle 14 is filled with a fluid. A filter 96 may be provided in the fluid path between the fluid reservoir 95 and the pick-up tube 93.

A first end of a piston arm 78 is rotatably coupled to the piston 72 and a second end of the piston arm 78 is rotatably coupled to a drive gear 60. The drive gear 60 is operably coupled to a drive shaft of an electric motor 84. A gear set 85 comprising one or more gears may be utilized between the drive gear 60 and the drive shaft of the electric motor 84, as described above. The electric motor 84 is mounted on or in the main body 12 of the paint brush 40. The motor 84 is electrically connected to a battery 86 through control electronics 94 and a control switch 34 as described above.

A one-way valve 74 is provided between the pick-up tube 93 and an outlet fluid flow path 76. Alternatively, the one-way valve 74 may be provided between the inlet to the pick-up tube 93 and the reservoir 95, or two one-way valves may be utilized as describe above. The outlet fluid flow path 76 may comprise a tube or lumen within the main body 12 and which extends distally to the inlet of a manifold 22. The outlets of the manifold 22 are in fluid communication with a plurality of fluid distribution members 24.

The piston pump is powered by an electric motor having a drive shaft and a gear attached to the drive shaft. The motor gear may be operably coupled to a drive gear. A first end of a piston arm is rotatably connected to the drive gear and a second end of the piston arm is rotatably connected to a piston rod of the piston pump. As the motor is operated, the assembly causes a reciprocating motion of the piston rod which creates a pumping pressure. An outlet fluid flow path is also in fluid communication with the pump cylinder, separated by a one-way valve which is closed during the suction stroke of the piston pump to block back-flow from the outlet fluid flow path and is open during the compression stroke to allow fluid to flow into the outlet fluid flow path. The outlet fluid flow path delivers the fluid to a manifold and plurality of fluid distribution members, the same or similar to those described above.

Thus, a completely self-contained, power-fed paint brush 40 is provided which delivers paint from a reservoir contained on the brush to the bristles of the brush without any remote or external pump, power source, or source of pressurized fluid.

FIGS. 7 and 8 show another innovative power-fed paint brush 110. The power-fed paint brush 110 includes all of the features of the brush 10 described above, and also includes an airless paint spray head 115. The distal end of the flow path 18 connects to a three-way valve 112, such as a three-way ball valve. The valve 112 can be set to direct the flow to the airless spray head 115 or to the manifold 22. The valve 112 may also have a shut position in which the valve closes the flow thereby preventing flow to both the manifold 22 and the spray head 115. The spray head 115 may be removable so that it can be replaced and/or cleaned. The flow path 18 is removably connected to a fitting on the manifold 22. As described above, any suitable connection may be used. The brush head is removably connected to the handle 14 using flexible clips 114 which are retained by detents 116. To remove the brush head 118, the clips 114 are simply pressed to release them from the detents 116.

The paint brush 110 is connected to a source of pressurized fluid in the same manner as the paint brush 10 described above. In the paint brush mode, the paint brush 110 is used the same way as the brush 10. To use the brush 110 in the spray mode, the brush head 118 is removed, the valve 112 is set to supply the paint to the spray head 115. The power-fed paint brush 110 can now be used as a paint sprayer. To convert the brush 110 back to paint brush mode, the brush head 118 is re-installed, and the valve 112 is set to supply the paint to the manifold 22.

In addition, the fully self-contained paint brush 40 can also be easily configured with the paint sprayer features of the brush 110 by adding a valve between the outlet fluid flow path 76 and the manifold 22 and adding a paint sprayer head in fluid communication with the valve.

Turning now to FIGS. 9-12, an air pressurized paint system is illustrated. The air pressurized paint system comprises a paint applicator, such as a powered paint brush 110 (shown in FIG. 9), a powered paint roller 150 (shown in FIGS. 10A-10B), and a pressurized paint canister 170 (shown in FIG. 11). In contrast to the powered paint brushes 10 and 40 having a positive displacement pump, as described above, this system uses a pressurized gas, such as compressed air from an air compressor, to pump the paint from the paint reservoir to the paint applicator.

Figures 11, 12:
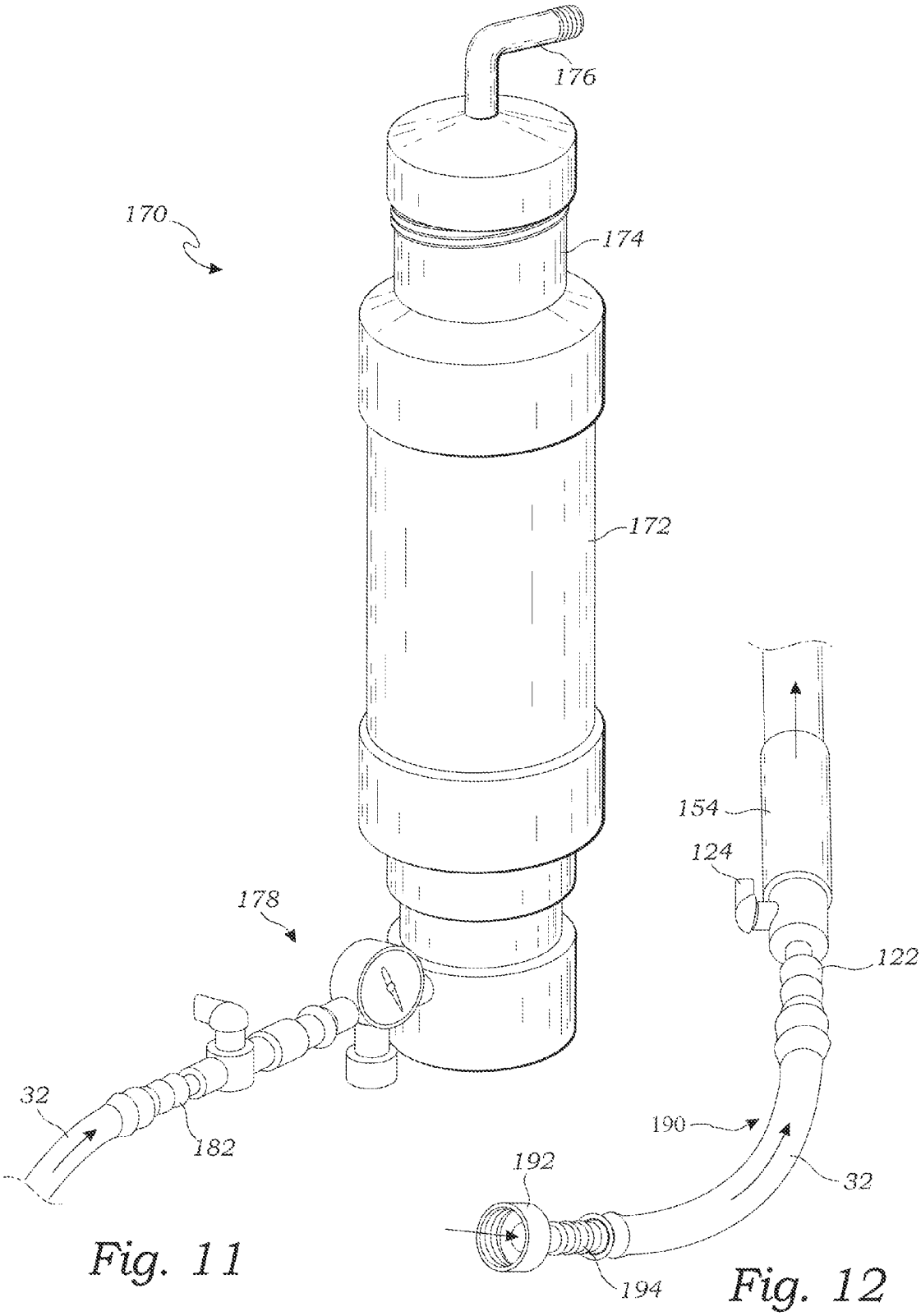
FIG. 11 is an elevational, perspective view of a pressurized paint canister for use with the power fed paint brushes and power fed roller according to one embodiment of the present invention.
FIG. 12 is a cleaning device according to one embodiment of the present invention.

Referring first to FIG. 11, the pressurized paint canister 170 comprises a paint reservoir 172 which can hold a desired amount of paint, for example, it could have a capacity of 1 quart, or 2 quart, or 1.5 quarts, or at least 1.5 quarts. The pressurized paint canister 170 is capable of withstanding a minimum amount of pressure suitable for pumping paint from the paint canister to a paint applicator. For example, the paint canister may be configured for at least 150 psi, or 100 psi or 50 psi or 200 psi, depending on the particular design. The top of the reservoir 172 is threaded to receive a removable, threaded cap 174. To fill the canister 170 with paint, the cap 174 is simply screwed off, and paint can be poured into the reservoir 172. The paint canister 170 has an air pressure fitting/valve 176 in fluid communication with the paint reservoir 172. The air pressure fitting/valve may be self-sealing, such as a Schrader valve. A source of pressurized gas is connected to the air pressure fitting to pressurize the canister. The air pressure valve 176 is connected to a source of pressurized air, such as an air compressor, a pump, or pressurized gas tank. The source of pressurized gas may be removed after pressurizing the canister 170 and the air pressure fitting 176 automatically closes to maintain the pressure within the canister 170. Thus, the paint canister 170 is portable. Alternatively, the source of pressurized air can remain connected to the source of pressurized gas, such as by using a long supply line.

At or near the bottom of the canister 170, a paint outlet assembly 178 is connected to the canister 170. The paint outlet assembly 178 is also in fluid communication with the paint reservoir 172. The paint outlet assembly 178 may comprise a pressure gauge, a shutoff valve, and a supply tube 32. The supply tube 32 may be removably connected using a barbed fitting 182 which provides a fluid tight (leak proof) connection. Alternatively, the supply tube 32 can be permanently attached to the rest of the paint outlet assembly 178. As discussed below, the other end of the supply tube 32 connects to a paint applicator thereby providing the paint applicator with a pressurized supply of paint.

The powered paint brushes 10 and 110 described above may be utilized with this air pressurized painting system by simply connecting the other end of the supply tube 32 to the connector 30. Of course, the paint brush 10 would not need the control switch 34 because there is no powered pump to turn on and off. Still, turning now to FIG. 9, a powered paint brush particularly well-suit for use with the air pressurized painting system of the present invention is illustrated. The powered paint brush 120 is very similar to the powered paint brushes 10 and 40 described above, and the above description of such elements applies equally with respect to the powered paint brush 110. While the quick disconnect connection 30 used in powered paint brush 10 can be used, a cheaper, simpler barbed fitting 122 is provided at the paint inlet of the brush 120. The supply tube 32 simply presses over the barbed fitting 122 to provide a secure, fluid tight seal, which can be disconnected and reconnected as desired.

A shut-off/throttle valve 124 is provided at the inlet to the powered paint brush 120. The shut-off/throttle valve 124 can be use to turn the paint supply on and off, and also can throttle the flow volume into the paint brush 120. The inlet flow path 18 is connected to a small cavity 126 within the main body 12 of the paint brush 120. The cavity 126 acts as a manifold to distribute the paint to one or more fluid distribution members 24. A tapered adapter 128 may be used to connect each of the fluid distribution members 24 to the cavity 126. The powered paint brush is connected to the pressurized paint canister 170 using the supply tube 32.

The use of the air pressurized paint brush 120 is the same as described above for powered paint brushes 10 and 110, except that the flow of paint is controlled by adjusted the shutoff/throttle valve 124, instead of the control switch 34.

Figure 10A:
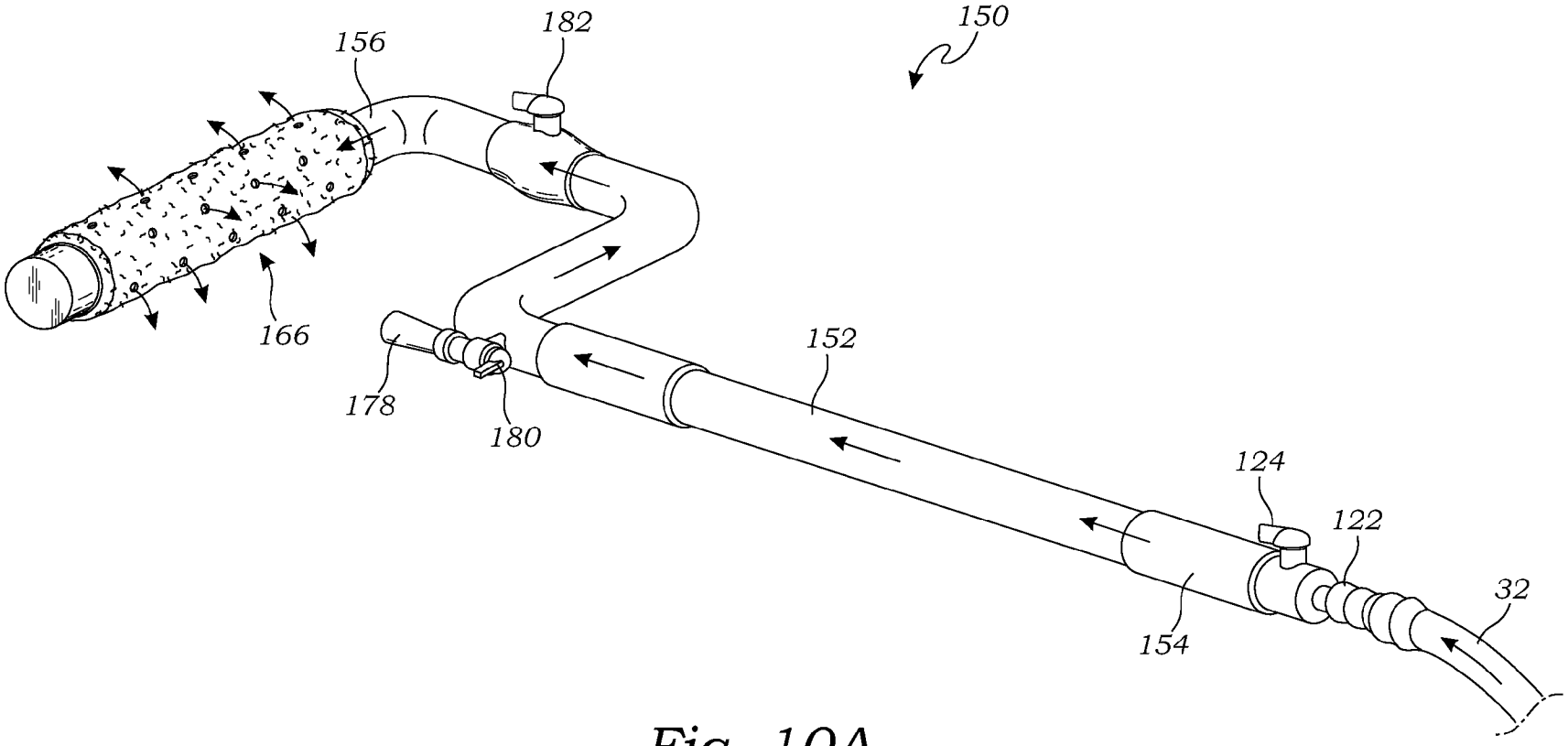
FIG. 10A is a perspective view of a power fed paint roller according to one embodiment of the present invention.
Figure 10B:
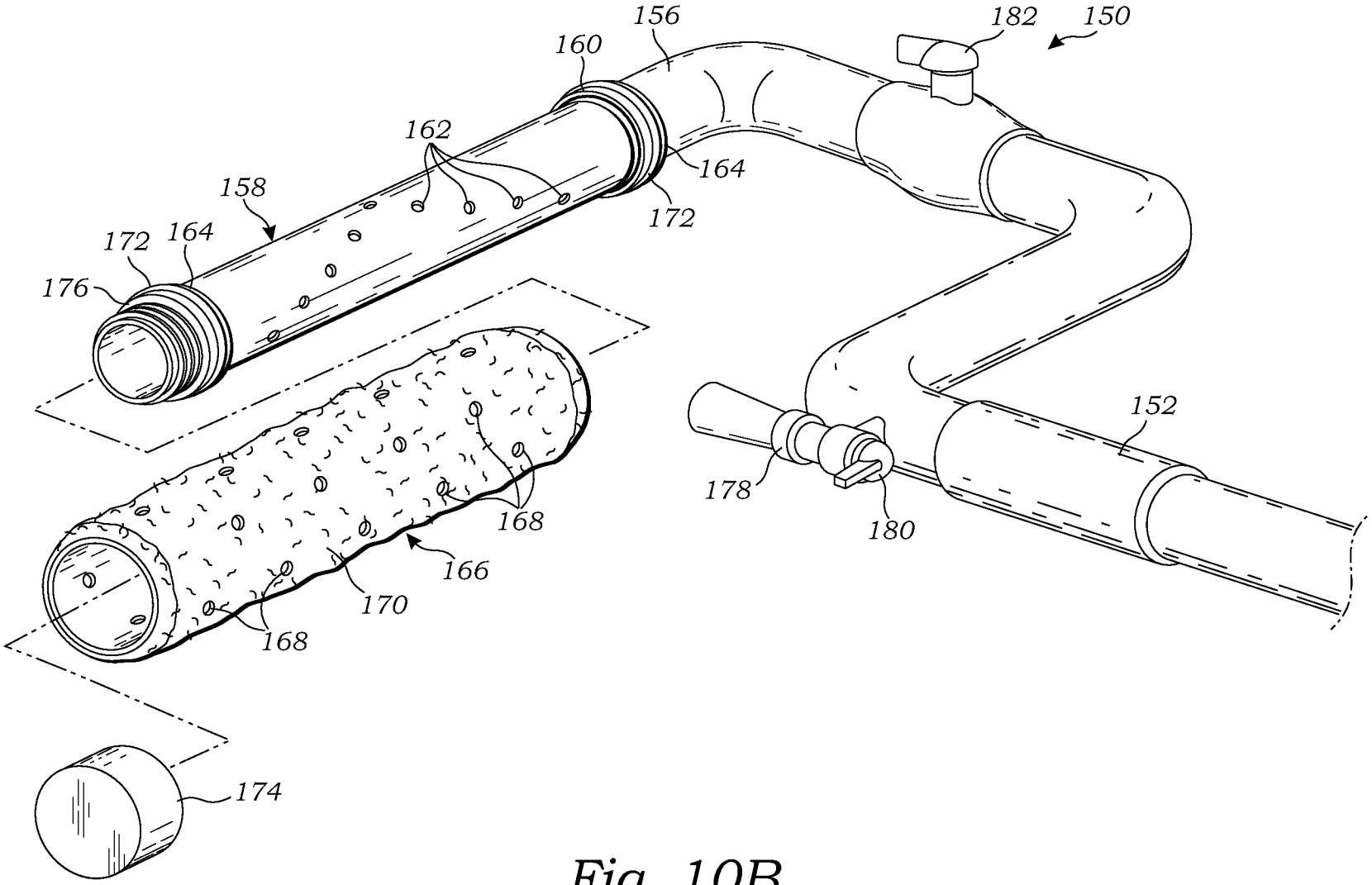
FIG. 10B is a perspective, exploded view of the power fed paint roller of FIG. 10A.

A powered paint roller 150 for use with the air pressurized painting system is shown in FIGS. 10A and 10B. The powered paint roller 150 comprises an elongate handle 152 having a proximal end 154 and a distal end 156. The handle 152 has a paint lumen extending from the proximal end 154 to the distal end 156. A barbed fitting 122 is provided at the inlet of the paint roller 150 for connection to the paint supply tube 32. A shutoff/throttle valve 124 may be provided to control the flow of paint to the roller 150 and to shutoff the flow of paint.

A first end 160 of a roller axle 158 is disposed on the distal end 156 of the handle 152. The roller axle 160 has a roller cavity which is in fluid communication with the paint lumen of the handle 152. The roller axle 158 has a set of axle outlet holes 162 extending from the roller cavity to the outer surface of the roller axle 158. The axle outlet holes 162 may be arranged in a spiral arrangement about the outer surface of the roller axle, or other suitable arrangement.

A pair of rotatable hubs 164 is rotatably disposed on the roller axle 158, one at each end of the roller axle 158. The roller hubs 164 rotate about the roller axle 158. The interior of the paint roller 166 press fits onto the roller hubs 164 to firmly secure the paint roller cover 166 onto the powered paint roller 150. The roller cover 166 has roller cover holes 168 extending from the interior of the roller cover 166 to the outer knap 170 of the roller cover to allow paint to flow to the outer knap 170. The outer knap may be any suitable material for a paint roller, such as sponge, fabric, etc. A fluid seal 172 is disposed on the roller axle 158 interiorly to each of the roller hubs 164 to provide a fluid tight seal between the roller axle 158 and each of the hubs 164. A threaded cap 174 screws onto the distal end 176 of the roller axle 158. The cap 174 retains the roller cover 166 onto the paint roller 150 when in use.

The powered paint roller 150 may also include a cleaning system. The cleaning system comprises a cleaning jet 178 attached to the handle 152 and aimed at the roller cover 166. The cleaning jet 178 is in fluid communication with the handle lumen. A cleaning jet shutoff valve 180 is provided to turn the cleaning jet 178 on and/or off. A second cleaning shutoff valve is also placed in fluid communication with the handle lumen downstream of the cleaning jet 178, but upstream of the roller axle 158.

Turning to FIG. 12, a cleaning device 190 comprises a garden spigot connector 192 connected to a first end of a tube 194. The second end of the tube 194 is adapted to be connected to the inlet connector 122 of either the powered paint brush 120 or the powered paint roller 120.

Using the cleaning device 190, clean-up of the powered paint brush 120 and the powered paint roller 10 is quick and easy. For the powered paint brush 120, the supply tube 32 is disconnected from the inlet connector 122. The second end of the tube 194 is then connected to the connector 122 of the powered paint brush. The garden spigot connector 192 is connected to a water source, such as a garden spigot, and the water is turned on. The flow of cleaning water to the powered paint brush 120 can be controlled using the valve 124. The bristles 17 and the fluid distribution members 26 are flexed to allow water to flow through the distribution members 26 and onto the bristles. Advantageously, the helical springs as distribution members force water toward the proximal end of the bristles (where the bristles connect to the handle), which is the hardest part of a paint brush to get clean.

Similarly, to clean the powered paint roller 150, the supply tube 32 is disconnected from the inlet connector 122 and the second end of the tube 194 is connected to the inlet connector 122. Again, the spigot connector 192 is connected to a garden spigot and the water is turned on. The cleaning jet shutoff valve 180 is opened to allow water to flow through the cleaning jet 178 such that water is sprayed onto the roller cover 166 thereby cleaning the knap 170 of the roller cover 166. During this part of the cleaning process, the second cleaning shutoff valve 182 may be closed so that all of the water flow is through the cleaning jet 178. Alternatively, the second cleaning shutoff valve 182 may be left open to simultaneously clean the roller axle 158 and the interior of the roller cover 166. Or, the cleaning jet shutoff valve 178 can be closed, and the second cleaning shutoff valve 182 can be opened to force all of the water flow through the roller axle 158 and through the interior of the roller cover 166.

The same cleaning system can be applied to any of the paint applicators described herein, and the same cleaning method can be used to clean such paint applicators. Such devices and methods are explicitly described and a part of the present invention.

Figures 13A, 13B:
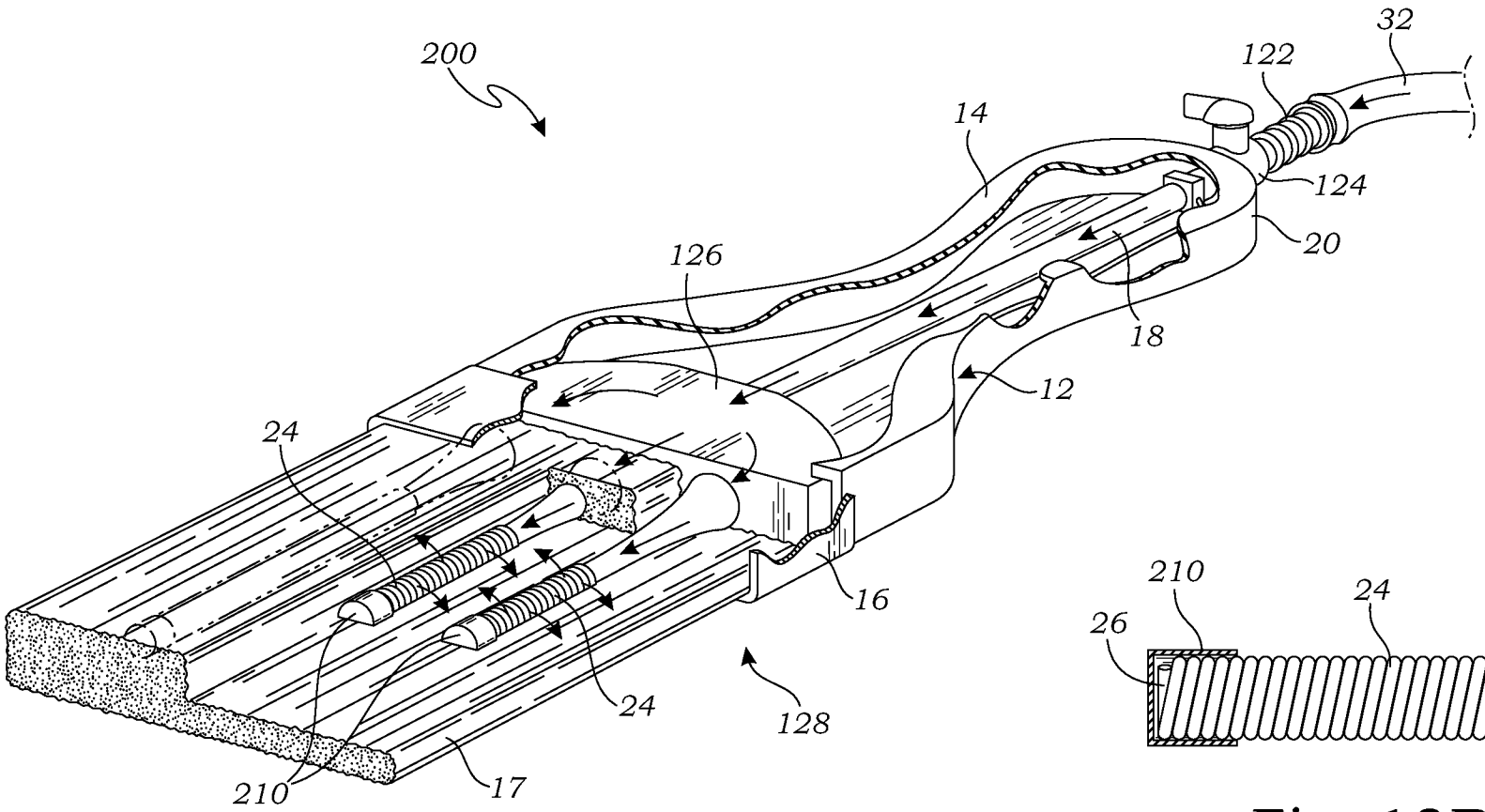
FIG. 13A is a perspective view (partially cut-away) of a pressurized fluid fed paint brush according to another embodiment of the present invention.
FIG. 13B is an enlarged view of the fluid distribution member and cap of FIG. 13A.

Referring now to FIGS. 13A-13B, another embodiment of a pressurized fluid fed paint brush 200 according to the present invention is shown. The paint brush 200 is substantially similar to the power fed paint brush 120 described above, and the description above for like elements applies equally for paint brush 200. The main differences between paint brush 120 and paint brush 200 is that paint brush 200 includes caps 210 on the distal end 26 of the distribution members 24 (see the enlarged view of FIG. 13B), and the distribution members only extend about half-way down length of the bristles 17.

The caps 210 provide several advantages. First, the caps 210 seal the distal end of the distribution members 24. Thus, when in the unflexed state, the fluid distribution members 24 of the brush 200 are closed such fluid cannot follow out of the distribution members 24, as opposed to the brush 10 described above which allows fluid to flow out of the distal ends 26. As described above, when flexed along with bristles 17 of the paint brush 200, the fluid distribution members 24 open thereby allowing fluid to flow out of the distribution members 24.

The fluid distribution members 24 are configured such that they can hold a minimum amount of pressure without opening in the unflexed state. This pressure is called the minimum holding pressure of the distribution members. For instance, in the embodiment in which the fluid distribution members 24 comprises helical springs 25 (see FIGS. 2 and 3), the springs 25 have a minimum amount of pre-tension greater than the force exerted on the spring from the expected operating pressure of the brush 210. The "pre-tension" of a spring is the minimum amount of force required to just start the spring stretching. The pre-tension in a spring causes the spring to collapse completely so that adjacent coils are in contact with each other. The minimum pre-tension of the spring can be calculated by determining the amount of stretching force on the spring 25 caused by the pressure of the fluid within the spring. 25 at the maximum operating pressure. The maximum operating pressure means the maximum pressure the brush is designed to operate at during use of the brush for painting. The maximum operating pressure may vary depending on the size of the brush 200, the size of the distribution members 24, and the type of fluid to be applied using the brush. The brush 200 may be configured to have a maximum operating pressure between 8 psi and 25 psi, but preferably about 8 psi, 10 psi, 12 psi, 15 psi, or 20 psi. As an example, if the springs 25 have in interior diameter of one quarter of an inch (¼"), and the operating pressure of the brush 200 is 10 psi, then the force stretching the springs caused by the fluid pressure is approximately the cross-sectional area of the springs multiplied by the pressure. In this example, the force caused by the fluid pressure is 0.16 pounds of force. As stated above, the pre-tension of the springs 25 should be slightly greater than the force exerted by the fluid pressure at the expected operating pressure. The pressure required to overcome the pre-tension of the spring is the minimum holding pressure. The pre-tension is preferably about 110%, or 125% or 150% of the force exerted by the fluid pressure at the maximum operating pressure. This will provide some tolerance margin for the operation of the brush. In another aspect, the maximum operating pressure of the brush 200 is about 15 psi or less and the holding pressure is about 20 psi or greater.

With the caps 210, the distribution members 24 are self-sealing. In other words, then the distribution members are unflexed, they stop the flow of fluid, and when they are flexed, such as by bending them along with the bristles 17 of the brush 200, the distribution members 24 allow fluid to flow out of them.

The fluid distribution members 24 are also configured so that they will open to allow fluid to flow out in the unflexed state, under a spring opening fluid pressure. This aspect is primarily related to the cleaning of the brush 200. The second end of the tube 194 of the cleaning device 194 is connected to the inlet connector 122 of the paint brush 200. When the water is turned on to the cleaning device 190, the water pressure is adjusted by the inlet water pressure and/or by the valve 124 to exceed the minimum holding pressure of the distribution members 24. However, as opposed to the brush 120, the bristles 17 and distribution members 24 of the brush 200 do not need to be flexed because the water pressure forces the distribution members to allow water to flow out of the distribution members 24 without being flexed. For instance, if the distribution members 24 comprise springs 25, then the water pressure forces the springs 25 to stretch which allows water to flow through the gaps between the coils of the springs 25.

In a very advantageous aspect, the distribution members 24 provide a very dynamic motion caused by the water pressure and the caps 210. The distribution members 24 flap about in a random motion, similar to the end of a garden hose when released with water flowing at a high pressure from the end of the hose. This dynamic cleaning action moves the distribution member 24 around within the bristles 17 which provides a very effective cleaning action.

While the present invention has been fully described above with particularity and detail in connection with what is presently deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A paint brush comprising:

a main body having a handle and a brush stock;

a bristle assembly secured in said brush stock;

a fluid flow path extending through said main body having a first end configured to be connected to a source of paint and a second end in fluid communication with a fluid distribution member having a sealed distal end; and said fluid distribution member extending into said bristle assembly and configured to prevent fluid from flowing out of the distribution member when in an unflexed state, and to distribute paint onto said bristle assembly when the distribution member is in a flexed state.

2. The paint brush of claim 1, wherein said fluid distribution member comprises a helical coil spring with a cap on the distal end of the helical coil.

3. The painting system of claim 2, wherein said fluid distribution member is configured to allow fluid to flow out of said fluid distribution member at paint pressures above a holding pressure, wherein the holding pressure is above a maximum operating pressure of the paint brush.

4. The paint brush of claim 2, wherein the coils of said spring are substantially closed when said spring is in an unflexed state and said coils open when the spring is flexed along with the flexure of the bristle assembly.

5. The painting system of claim 4, wherein said fluid distribution member is configured to allow fluid to flow out of said fluid distribution member at paint pressures above a holding pressure, wherein the holding pressure is above a maximum operating pressure of the paint brush.

6. The paint brush of claim 1, wherein said fluid distribution member is multidirectionally flexible such that when said bristle assembly is flexed in any direction, said fluid distribution member flexes substantially freely along with said bristle assembly.

7. The paint brush of claim 6, wherein said fluid distribution member comprises a helical coil spring with a cap on the distal end of the helical coil.

8. The paint brush of claim 7, wherein the coils of said spring are substantially closed when said spring is in an unflexed state and said coils open when the spring is flexed along with the flexure of the bristle assembly.

9. The painting system of claim 8, wherein said fluid distribution member is configured to allow fluid to flow out of said fluid distribution member at paint pressures above a holding pressure, wherein the holding pressure is above a maximum operating pressure of the paint brush.

10. The paint brush of claim 1, further comprising a shut-off/throttle valve provided inline with said fluid flow path.

11. The paint brush of claim 1 further comprising a control switch provided on said main body for controlling the flow of fluid from the source of paint.

12. The paint brush of claim 11, wherein the source of paint is a source of pressurized paint comprising one of a fluid pump unit or a gas pressurized canister.

13. The paint brush of claim 11 wherein said control switch is an electrical switch which is configured to be operably coupled to the source of paint.

14. The paint brush of claim 13, wherein the source of paint is a source of pressurized paint comprising a fluid pump unit.

15. The paint brush of claim 11 wherein said control switch operates a wireless signal to the source of paint.

16. The paint brush of claim 15, wherein the source of paint is a source of pressurized paint comprising a fluid pump unit.

17. A paint brush comprising:

a main body and a brush stock;

a bristle assembly secured in said brush stock;

a fluid flow path having a first end configured to be connected to a source of paint and a second end in fluid communication with a fluid distribution member having a sealed distal end; and said fluid distribution member extending into said bristle assembly and configured to prevent fluid from flowing out of the distribution member when in an unflexed state, and to distribute paint onto said bristle assembly when the distribution member is in a flexed state.

18. The paint brush of claim 17, wherein said fluid distribution member comprises a helical coil spring with a cap on the distal end of the helical coil.

19. The painting system of claim 18, wherein said fluid distribution member is configured to allow fluid to flow out of said fluid distribution member at paint pressures above a holding pressure, wherein the holding pressure is above a maximum operating pressure of the paint brush.

20. The paint brush of claim 18, wherein the coils of said spring are substantially closed when said spring is in an unflexed state and said coils open when the spring is flexed along with the flexure of the bristle assembly.

* * * * *